United States Patent [19]

Feldman

[11] 4,404,002

[45] Sep. 13, 1983

[54] ZIRCONIUM ADDITIVES FOR RESIDUAL FUEL OIL

[75] Inventor: Nicholas Feldman, Woodbridge, N.J.

[73] Assignee: Exxon Research and Engineering Co., Florham Park, N.J.

[21] Appl. No.: 405,871

[22] Filed: Aug. 6, 1982

Related U.S. Application Data

[63] Continuation-in-part of Ser. No. 296,016, Aug. 25, 1981, abandoned.

[51] Int. Cl.[3] ..... C10L 1/30

[52] U.S. Cl. ..... 44/68; 44/76; 44/77; 44/78

[58] Field of Search ..... 44/67, 68, 77, 78, 76

[56] References Cited

U.S. PATENT DOCUMENTS 2,197,498 4/1940 Guthmann ..... 44/9
3,634,051 1/1972 Phillips ..... 44/51
4,297,110 10/1981 Feldman ..... 44/66

FOREIGN PATENT DOCUMENTS 837407 1/1959 United Kingdom .
1377927 12/1974 United Kingdom .

*Primary Examiner*—Charles F. Warren
*Assistant Examiner*—Y. Harris-Smith
*Attorney, Agent, or Firm*—Eugene Zagarella

[57] ABSTRACT

A composition for reducing the amount of particulate matter formed during the combustion of residual fuel oil, particularly No. 6 fuel oil, comprising a residual fuel oil and an effective amount of selected oil soluble zirconium salts of an alcohol/phenol or sulfonate. Another embodiment involves a process for reducing the amount of particulate matter formed during combustion of a residual fuel oil which comprises combustion of a residual fuel oil which contains an effective amount of a selected zirconium salt of alcohol/phenol or sulfonate.

15 Claims, No Drawings

ZIRCONIUM ADDITIVES FOR RESIDUAL FUEL OIL

CROSS-REFERENCE TO RELATED APPLICATION

This application is a continuation-in-part of Ser. No. 296,016 filed Aug. 25, 1981, now abandoned.

BACKGROUND OF THE INVENTION

1. Field of the Invention

This invention relates to the use of specific zirconium salts in residual fuel oil to reduce the amount of particulate matter formed during combustion.

2. Brief Description of the Prior Art

Residual fuel oils, including Grades Nos. 4, 5 and 6 (ASTM D-396), are widely used in a variety of industrial heating and steam boiler applications. A particularly desired fuel oil is No. 6, which is extensively used by utility and power companies.

State and federal EPA emission standards are currently limiting the use of residual fuels which produce excessive amounts of particulate emission during combustion and thus are not in compliance with standards.

However, the situation is relatively complicated, since state-to-state emission standards tend to be different and compliance by a residual fuel oil in one state may not necessarily be achieved in another, and further, since standards are continuously subject to change, a fuel oil currently in compliance may not be in compliance in the near future in the same location and under the same end-use conditions.

Fuels which tend to produce excessive amounts of particulate emission generally have one or more characteristics associated with them: a sulfur content above about 1 percent; a Conradson Carbon Residue (ASTM D-189, also termed "Con Carbon" in the art) above about 7 percent; or a high asphaltene content. Fuels yielding particulate emissions that surpass the existing standards can't be directly used, but in some cases can be blended in admixture with fuels that do meet existing standards, which are generally low in sulfur and/or low in "Con Carbon" and asphaltene content. This situation has resulted in an overall increased demand for fuel oils which meet emission standards despite their diminishing supply and attendant increase in cost.

What is desired is a process for increasing the utility of these high emission yielding residual fuel oils for industrial heating purposes in a manner that results in acceptable particulate emissions, despite a high sulfur content, a high Con Carbon residue and/or high asphaltene content.

In the area of related problems, it is known in the art that the use of specific additives in certain hydrocarbon fuels, can reduce smoke or soot upon combustion, in certain instances. It is also known to use specific additives in fuels to inhibit corrosion, inhibit slag formation in boilers and to reduce the deleterious effect of vanadium present in such fuels.

However, it has not been shown to use selected additives to reduce particulate emission during combustion of residual fuel oil, and particularly No. 6 fuel oil.

SUMMARY OF INVENTION

It has unexpectedly been found that by adding a selected oil soluble zirconium salt of an alcohol/phenol or sulfonate to a residual fuel oil, and particularly No. 6 fuel oil the amount of particulate matter formed during combustion can be significantly reduced in amounts of 10 to 25 percent or greater.

In accordance with this invention, there is provided a process and composition for reducing the amount of particulate matter formed during the combustion of a residual fuel oil. More particularly, this invention involves a composition comprising a residual fuel oil and an effective trace amount of an additive selected from the group consisting of:

(i) an oil soluble zirconium salt of an alcohol or phenol having the formula:

$$ROH$$

where R is a hydrocarbyl group of 2–24 carbon atoms; or (ii) an oil soluble zirconium salt of sulfonic acid having the formula:

$$RSO_3H$$

where R is an alkyl cycloalkyl, aryl, alkaryl or aralkyl group and said salt has a molecular weight of about 100 to about 2500; said amount being effective in reducing the amount of particulate matter formed during combustion as compared to said combustion process conducted in the absence of said zirconium salt.

In another embodiment of this invention a process is provided for reducing the amount of particulate matter formed during the combustion of residual fuel oil which comprises combusting a residual fuel oil which contains an effective trace amount of a zirconium salt of alcohol or phenol, as described herein, or a zirconium salt of sulfonic acid, as described herein, said amount being effective in reducing the amount of particulate matter formed during combustion.

DESCRIPTION OF THE INVENTION AND PREFERRED EMBODIMENTS

The novelty of the present invention resides in the discovery that zirconium salts of certain alcohols/phenols or sulfonic acids exert a beneficial effect on residual fuel oil, particularly No. 6 fuel oil, in reducing the amount of particulate matter formed during combustion. The term "residual fuel oil" as used herein, is well-known and as described hereinabove, and includes Grades No. 4, No. 5 and No. 6 residual fuel oils, meeting the specifications of ASTM D-396. Particularly preferred is No. 6 fuel oil.

The reason these particular zirconium additives exhibit this surprising effect is not clearly understood. It may be that the subject compounds promote and activate the complete oxidation of hydrocarbon and sulfur-containing constituents in the fuel to volatile or gaseous compounds during combustion, in a highly specific manner.

The subject zirconium salts or compounds, also termed "additives" herein, operative in the instant invention, comprise oil soluble zirconium salts of an alcohol/phenol or sulfonate. The zirconium salt of selected alcohols or phenols will be a zirconium salt of an alcohol or phenol having the formula:

$$ROH$$

where R is a hydrocarbyl group of 2 to 24 carbon atoms. More particularly R is a branched or unbranched, hydrocarbyl group preferably having 2 to 13 carbon atoms. Preferred compounds are those where R is a saturated or unsaturated aliphatic group having 2 to 8 and more preferably 3 to 4 carbons. Most preferred are those compounds where R is a saturated aliphatic group, and particularly those having 3 to 4 carbons. Compounds of this type include R groups which may be alkyl, aryl, alkaryl, aralkyl and alkenyl. Illustrative alcohol or phenol compounds of this type include ethanol, propanol, butanol, hexanol, decanol, octadecanol, eicosanol, phenol, benzyl alcohol, xylenol, naphthol, ethyl phenol, crotyl alcohol etc. Further information and description of the useful alcohols of this type may be found in Kirk-Othmer, "Encyclopedia of Chemical Technology" Second Edition, 1963, Vol. 1, pp 531–638.

The zirconium salt of sulfonic acids useful in this invention are the zirconium salts of sulfonic acids having the formula:

$$RSO_3H$$

where R is a hydrocarbyl group having 2 to 200 and preferably 10 to 60 carbon atoms. More particularly, the R group in said sulfonic acids will be an alkyl, cycloalkyl, aryl, alkaryl or aralkyl and said salt will have a molecular weight of about 100 to about 2500, preferably about 200 to about 700.

The sulfonic acids are characterized by the presence of the sulfo group $-SO_3H$ (or $-SO_2OH$) and can be considered derivatives of sulfuric acid with one of the hydroxyl groups replaced by an organic radical. Compounds of this type are generally obtained by the treatment of petroleum fractions (petroleum sulfonates). Because of the varying natures of crude oils and the particular oil fraction used, sulfonates generally constitute a complex mixture and it is best to define them in a general manner giving the molecular weight as defined above. Particularly preferred sulfonates are those having an alkaryl group, i.g. alkylated benzene or alkylated naphtalene.

Illustrative examples of sulfonic acids useful in this invention are: dioctyl benzene sulfonic acid, dodecyl benzene sulfonic acid, didodecyl benzene sulfonic acid, dinonyl naphthalene sulfonic acid, dilauryl benzene sulfonic acid, lauryl cetyl benzene sulfonic acid, polyolefin alkylated benzene sulfonic acid such as polybutylene and polypropylene, etc. Further details regarding sulfonic acids may be found in Kirk-Othmer, "Encylopedia of Chemical Technology", Second Edition, 1969, Vol. 19, pp 311 to 319 and in "Petroleum Sulphonates" by R. Leslie in Manufacturing Chemist, October 1950 (XX1, 10) pp 417 to 422.

Methods of preparing the subject zirconium salts described above are well known in the art and generally said salts are commercially available.

The zirconium additive is incorporated into the residual fuel oil by dissolving therein. This is accomplished by conventional methods as by heating, stirring and the like.

The amount of zirconium additive to be used is an "effective trace amount" that will reduce the amount of particulate matter formed during combustion of the residual fuel oil as compared to the combustion of said fuel oil in the absence of said additive. By the term "effective trace amount" is quantitatively meant an amount of about 1 to 1000 ppm by weight and preferably 10–500 ppm by weight, zirconium additive, taken as metallic zirconium, in said fuel oil, and particularly preferred about 50 to 150 ppm by weight zirconium additive, taken as metallic zirconium, in said fuel oil. However, lower and higher amounts than the 1–1000 ppm range can also be present provided an effective trace amount, as defined herein, is present in the residual fuel oil.

By the term "reduce the amount of particulate matter formed during combustion", as used herein, is meant that at least about a five percent reduction in formed particulate matter, and preferably from about 10 to 25 percent and greater, reduction in formed particulate matter is achieved as compared to the combustion of the residual fuel oil in the absence of the subject zirconium additive.

In the process, the fuel oil containing said additive is generally mixed with oxygen, usually in the form of air, to form a fuel/air mixture prior to combustion. Generally, the amount of air utilized is an excess over the stoichiometric amount to completely combust the fuel oil to carbon dioxide and water. The reason for utilizing this excess is that complete mixing does not always occur between the fuel oil and the air, and that also a slight excess of air is desirable since it serves to reduce the tendency of soot and smoke formation during combustion. Generally, the excess of air used is about 2 to 35 percent (0.4 to 7 percent based on oxygen) over the stoichiometric amount depending upon the actual end-use conditions which may vary considerably from one type of industrial boiler to the next. One disadvantage in using a large excess of air is that a greater amount of heat is lost through entrainment that would otherwise be utilized for direct heating purposes. We have found that by use of the subject zirconium additives, less excess air is required to reduce smoke and soot formation and thus the heating efficiency of the residual fuel oil is greater, as well as resulting in a reduction of particulate emission.

The above-described step of mixing fuel oil and air is conventional and is usually accomplished for example, by steam or air atomization to produce a fine spray which is then combusted to maintain and support a flame. The combustion is controlled and conducted at a particular "firing rate" which is usually expressed as lbs/minute of fuel oil combusted.

The combustion of residual fuel oil is usually carried out in conventional industrial boilers, utility boilers, refinery furnaces and the like.

The amount of particulate matter formed during combustion of residual fuel oil will vary over a broad range and is dependent upon a number of factors such as type of boiler, boiler size, number and type of burners, source of the residual fuel oil used, amount of excess air or oxygen, firing rate and the like. Generally, the amount of particulate matter formed will be in the range of about 0.01 to 1.0 weight percent of the fuel oil used and higher. One weight percent corresponds to one gram particulate matter formed from the combustion of 100 grams of fuel oil. The amount of particulate matter formed, herein termed "total particulate matter," is actually the sum of two separate measurements; "tube-deposits," the amount of particulate matter deposited inside of the boiler, and two, "filtered stack particulate," which is the amount of particulate matter formed which escapes the boiler and is actually emitted out of the stack into the air. EPA measurements are generally only concerned with filtered stack particulate which is directly released into the air environment and contributes to a decrease in air quality. However, "tube deposits" lead to corrosion of the equipment, frequent "cleanouts" and add to the total operating costs. Furthermore, as tube deposits collect on the inside of the apparatus, a critical crust thickness is reached and further tube deposits are then entrained in stack particulate, which significantly increases the amount of particulate emission. Thus, in order to fully assess the overall operating advantages of a particular residual fuel oil in a boiler operation, the amount of tube deposits should also be considered, as well as total stack particulate for compliance with emission standards.

The amount of allowed stack particulate will vary from state to state and is also subject to a minimum amount allowed under Federal EPA standards. For example, in Florida, the currently allowable limit for existing power plants is 0.10 lbs. particulate emission per million BTU, which is equivalent to about 0.185 weight percent of particulate stack emission per weight of combusted fuel oil. Since the allowable emission standards will vary from jurisdiction to jurisdiction, differing amounts of the subject zirconium additive will be necessary to produce a residual fuel oil composition in compliance with those standards.

Measurement of the amount of "stack particulate matter" is conducted by EPA Method #5 Stack Sampling System, "Determination of Particulate Emissions from Stationary Sources" and is described in the Federal Register.

The particulate stack emissions are generally comprised of particulate carbon, sulfur-containing hydrocarbons, inorganic sulfates and the like.

The following examples are illustrative of this invention and should not be construed as being limitations on the scope and spirit of such invention.

EXAMPLE 1

Combustion runs were carried out in a 50 horsepower ABCO, 2-pass, water jacketed forced draft boiler with an air-atomizing burner and a nominal firing rate of 1.2 lbs/min. of residual fuel oil. The boiler was modified so that closure on each end could be opened easily for recovery of deposits laid down in the boiler. Two other modifications included installation of a second fuel system so the boiler could be heated to operating temperatures on No. 2 oil and then switched over to the test fuel without shutting down or upsetting the boiler operation unduly and installation of a two foot length of firebrick lining at the burner end of the firetube and a Cleaver-Brooks nozzle assembly in place of the Monarch nozzle. These modifications eliminated oil pooling and rapid carbon deposits on the firetube walls when residual fuel was fired. The first pass is a 49 cm (18.375 in.) diameter × 178 cm (5 ft. 10 in.) long fire tube; the second pass consists of 52 tubes each 6 cm (2.375 in.) diameter × 188 cm (6 ft. 2 in.) long.

Atomization of the fuel was accomplished using a low pressure air-atomizing nozzle. Viscosity of the fuel oil at the nozzle was maintained at 30 centistokes by heating the oil to a predetermined temperature (about 105° C.). Prior to contacting the burner gun, the atomized fuel oil was mixed with a measured amount of excess "secondary" air which was forced through a diffuser plate to insure efficient combustion. The secondary air was provided by a centrifugal blower mounted in the boiler head. The amount of secondary air was controlled by means of a damper which was regulated to keep the oxygen level in the atomized fuel at about 1.5% in excess (over that needed stoichiometrically to completely combust the fuel).

A run was started by firing the boiler and heating it to operating temperature for 55 minutes using No. 2 oil. The feed was then switched to test fuel and after allowing sufficient time for conditions to stabilize (about 25 minutes) samples of about 10 minutes duration were collected isokinetically from the stack on tared, Gelman, Type A (20.3 × 25.4 cm) fiber glass filters. The test fuel was a No. 6 fuel oil.

Total particulate matter formed was determined by adding the amount of Stack particulate measured isokinetically (EPA Method 5 Stack Sampling System) to the amount deposited in the tubes of the boiler i.e. "tube deposits".

The EPA Method 5 Stack Sampling System was conducted with a commercially available system for this purpose. This unit consisted of an 18-inch glass lined probe, a cyclone, a 125 mm glass fiber filter and four impingers. The first two impingers contained water, the third was empty and the last one contained silica gel. With the exception of the impingers, the entire sampling train was maintained at about 175° C. to insure that the stack gases entering the sampling system were above the $H_2SO_4$ dew point.

The deposits laid down in each of the 52 tubes is collected on a separate, tared 20.3 × 25.4 cm fiberglass filter. Deposits are collected by positioning a specially-designed filter holder against the end of each tube in turn, pulling air through the tube and the filter using a high-volume vacuum pump and manually brushing the tube from end-to-end ten times with a 2.50 inch diameter wire shank brush. The brush is mounted on a 8 ft. long, 0.25 in. diam. SS rod driven by an electric drill. This method gives almost 100% recovery of the deposits laid down in the tubes. All the tubes are sampled because for a given run there are large differences in deposit weight from tube-to-tube in each row of tubes across the boiler and from top row to bottom row and there is no consistent ratio of the weight of the deposit collected from a given tube from run-to-run.

The fuel oil used (Test Fuel) in the runs analyzed for the following constituents:

| Analysis of Test Fuel | |
|---|---|
| Sulfur | 2.0 wt % |
| ConCarbon[a] | 14.8 wt % |
| Ash[b] | 0.1 wt % |
| Vanadium | 469 ppm |
| Nickel | 70 ppm |
| Iron | 2.9 ppm |

[a]ASTM-D-189
[b]ASTM-D-482

The zirconium additive used in the run was zirconium propoxide an alcohol salt and was present in a concentration of 100 ppm taken as metallic zirconium.

For test fuel alone, the stack particulate was 0.34 wt% on fuel, while the tube deposits was 0.20 wt% on fuel for a total test particulate wt% of 0.54. The sample of fuel containing the zirconium propoxide measured a stack particulate of 0.24 wt% on fuel and tube deposits of 0.16 wt% on fuel for a total particulate wt% of 0.40. The improvement in using the zirconium additives was a reduction in total particulates of 25.9%.

EXAMPLE 2

Following the same general procedure and using the ABCO boiler described in Example 1, a sample run using 100 ppm of a zirconium sulfonate additive, i.e.

zirconium salt of dodecyl benzene sulfonic acid, was made with the same No. 6 fuel oil as in said Example 1.

The results for the sample containing zirconium sulfonate were a stack particulate of 0.29 wt% on fuel and tube deposits of 0.18 wt% on fuel for a total particulate of 0.47 wt% on fuel. The improvement in using the zirconium additive was a reduction in total particulate of 13.0%.

What is claimed is:

1. A process for reducing the amount of particulate matter formed during the combustion of a residual fuel oil which comprises combusting a residual fuel oil which contains an effective trace amount of an additive selected from the group consisting of:

(i) an oil soluble zirconium salt of an alcohol or phenol having the formula:

ROH where R is a hydrocarbyl group of 2 to 24 carbon atoms; or (ii) an oil soluble zirconium salt of a sulfonic acid having the formula:

$RSO_3H$ where R is an alkyl, cycloalkyl, aryl, alkaryl or aralkyl group and said salt has a molecular weight of about 100 to about 2500; said amount being effective in reducing the amount of particulate matter formed during combustion.

2. The process of claim 1 wherein said additive is present in said fuel oil is an amount of about 1 to about 1000 ppm by weight, taken as metallic zirconium.

3. The process of claim 2 wherein said fuel oil is No. 6 fuel oil.

4. The process of claim 3 wherein said fuel oil contains above about 1 weight percent sulfur.

5. The process of claim 1 wherein said additive is a zirconium salt of alcohol or phenol having an R group which is a saturated or unsaturated aliphatic group having 2 to 8 carbons.

6. The process of claim 5 wherein said additive is present in said fuel oil in an amount of about 1 to about 1000 ppm by weight, taken as metallic zirconium.

7. The process of claim 6 wherein said fuel oil is No. 6 fuel oil.

8. The process of claim 1 wherein said additive is a zirconium salt of sulfonic acid having an R group which is an alkaryl group and said salt has a molecular weight of about 200 to about 700.

9. The process of claim 8 wherein said additive is present in said fuel oil in an amount of about 1 to about 1000 ppm by weight, taken as metallic zirconium.

10. The process of claim 9 wherein said fuel oil is No. 6 fuel oil.

11. A composition comprising a residual fuel oil and an effective trace amount of an additive selected from the groups consisting of:

(i) an oil soluble zirconium salt of an alcohol or phenol having the formula:

ROH where R is a hydrocarbyl group of 2 to 24 carbon atoms; or (ii) an oil soluble zirconium salt of a sulfonic acid having the formula:

$RSO_3H$ where R is an alkyl, cycloalkyl, aryl, alkaryl or aralkyl group and said salt has a molecular weight of about 100 to about 2500; said amount being effective in reducing the amount of particulate matter formed during combustion.

12. The composition of claim 2 wherein said additive is present in an amount of about 1 to about 1000 ppm by weight, taken as metallic zirconium.

13. The composition of claim 12 wherein said fuel oil is No. 6 fuel oil.

14. The composition of claim 12 wherein said additive is a zirconium salt of alcohol or phenol having an R group which is a saturated or unsaturated aliphatic group of 2 to 8 carbons.

15. The composition of claim 12 wherein said additive is a zirconium salt of sulfonic acid having an R group which is an alkaryl group and said salt has a molecular weight of about 200 to about 700.

* * * * *